United States Patent [19]

Suda et al.

[11] 4,373,468

[45] Feb. 15, 1983

[54] DEVELOPING APPARATUS

[75] Inventors: Masashi Suda, Iruma; Junichiro Kanbe, Tokyo, both of Japan

[73] Assignee: Canon Kabushiki Kaisha, Tokyo, Japan

[21] Appl. No.: 149,451

[22] Filed: May 13, 1980

[30] Foreign Application Priority Data

May 17, 1979 [JP] Japan ..... 54-60783

[51] Int. Cl.[3] ..... G03G 15/09

[52] U.S. Cl. ..... 118/658; 355/3 DD

[58] Field of Search ..... 118/653, 657, 658, 262; 430/122; 355/3 DD; 220/1 H, 259, 230; 141/286, 339

[56] References Cited

U.S. PATENT DOCUMENTS

| | | | |
|---|---|---|---|
| 1,755,042 | 4/1930 | Zoller | 220/259 |
| 2,842,280 | 7/1958 | Nelson | 220/1 H |
| 2,932,545 | 4/1960 | Foley | 220/230 X |
| 3,953,121 | 4/1976 | Reichart, Jr. | 355/3 DD |
| 4,052,959 | 10/1977 | Hayashi et al. | 118/652 X |
| 4,081,571 | 3/1978 | Nishihama et al. | 118/657 X |
| 4,194,830 | 3/1980 | Ohnuma et al. | 355/3 DD |
| 4,258,372 | 3/1981 | Ishikawa | 355/3 DD X |

FOREIGN PATENT DOCUMENTS

| | | | |
|---|---|---|---|
| 2737147 | 2/1978 | Fed. Rep. of Germany | 355/3 DD |

*Primary Examiner*—Evan K. Lawrence

*Attorney, Agent, or Firm*—Fitzpatrick, Cella, Harper & Scinto

[57] ABSTRACT

A developing apparatus includes a developer vessel for supplying one-component magnetic toner as a developer, a movable developer carrier having a surface for receiving the developer, a magnetic thickness limiting member disposed close to the surface of the carrier, a fixed magnet positioned within the carrier with a magnetic pole in facing relationship with the limiting member, a mounting assembly for mounting the limiting member for movement toward and away from the facing magnet pole and including a lock for maintaining the limiting member at a predetermined distance from the carrier. The carrier is preferably a sleeve, the shaft ends of which are mounted on the reservoir, with the magnet journaled to the sleeve with one end extending through the associated sleeve shaft and having a rotation preventing member connected thereto. The sleeve is rotated through a driving connection between a gear mounted on a latent image bearing member and one associated with the sleeve.

The developer vessel may include an outer lid with a magnetic seal and an inner lid having edges which define an aperture and block reverse developer flow. The apparatus may further include felt sealing elements located adjacent to the opposite ends of the sleeve to direct developer inwardly along the sleeve away from the sleeve ends.

24 Claims, 20 Drawing Figures

DEVELOPING APPARATUS

BACKGROUND OF THE INVENTION

1. Field of the Invention

This invention relates to a developing apparatus, particularly a developing apparatus for visualizing latent images by the use of a one component magnetic developer.

2. Description of the Prior Art

In general, dry developing methods for developing electrostatic charge patterns can be divided into a two component developing process and a one component developing process. In the former process, the developer comprises a mixture consisting of carrier particles such as iron powder, glass beads or the like and toner particles for developing electrostatic images actually. This two component developing process has disadvantages in that changes in the ratio of carrier particles to toner particles results in variations of density between pictures and in that the deterioration of carrier particles leads to the reduction of quality in pictures.

On the other hand, the one component developing process does not have such disadvantages as in the two component developing process since it utilizes no carrier particle. Among the various developing processes, therefore, this one component developing process is highly hopeful. A certain one component developer which is generally known and used includes magnetic particles mixed with the toner particles for preventing frictional charging due to the relative movement between the particles and for obtaining a certain means which conveys the developer toward a development area opposed to electrostatic images.

The amount of the magnetic particles which are contained in the developer is limited by the fact that the toner is fixed on a transfer paper by heat, pressure or the like to form a toner image thereon. Practically, the developer includes 10% by weight to 60% by weight of the magnetic particles relative to the toner particles. However, the toner and magnetic particles are different from each other in specific gravity so that a volume occupancy of the magnetic particles in the toner will be of 20% or less. In such a small volume occupancy of the magnetic particles, it will be difficult for the toner to form long brushes of low density at a magnetic pole. When a layer of toner is limited in thickness on a toner carrying member to a few milimeters, it is easy for to the toner layer to become uneven.

It is easy for the unevenness of the toner layer on the carrying member to show up in the developed images. Moreover, if a dense layer of toner is uneven in thickness, the toner particles may be agglomerated when they are pressed against the surface of a photoconductive member which is an electrostatic image bearing member. Such an agglomeration may damage the photoconductive member. In the one component developing process, therefore, it is required to form thin layers of toner having even thickness on the toner carrying member.

In order to control the thickness of particle layer on the carrying member, a thickness limiting member can be generally used to form a narrow slit between the carrying member and the limiting member. When the carrying member is moved relative to the thickness limiting member, a toner layer which can be actually obtained thereby will have its thickness larger than that of said slit.

Under such a situation, the thickness limiting member of the prior art must be positioned extremely close to the toner carrying member. This means that an accuracy will be extremely necessary in manufacturing. Furthermore, this means that the narrow slit may be clogged by the toner particles agglomerated due to various causes to form no toner layer.

Therefore, the thickness limiting member must be constructed in the optimum conditions such as materials, shapes, positions and the other so as to form the evenly thin layers of toner on the carrying member.

Even if evenly thin layers of toner can be formed on the toner carrying member, irregularities in development are produced unless the toner carrying member is maintained relative to the image bearing member such as a photosensitive member or the like at a constant distance. Particularly, in such development processes as described in U.S. patent application Ser. Nos. 938,101 and 938,494 and Ser. Nos. 58,434 and 58,435 which are improved by using an AC bias in the above U.S. patent applications, the toner layers are limited to a thickness smaller than the gap between the toner carrying member and the image bearing member so that the variations in said gap will extremely affect reproduced pictures in development irregularity and the like.

In the prior art developing apparatus in which a toner carrying member such as a non-magnetic sleeve is rotatably driven by an image bearing member through a gearing therebetween, excess forces may be applied on the toner carrying member to change said gap or to damage the surface of the image bearing member. This must be also avoided.

The toner particles which have not been used in development must be all collected in a development vessel to prevent them from flying. Flying toner particles will adhere, for example, to the discharging wires of a corona discharging device resulting in charge irregularities, reduction of picture's density or the like.

While various developing devices are utilized in electrographic reproduction machines which are presently used in many offices, it is difficult to effect stable development and thus image-forming over a prolonged period of time in these developing devices unless the above problems are solved.

SUMMARY OF THE INVENTION

It is an object of this invention to provide a developing apparatus in which stable development can be accomplished over a prolonged period of time by overcoming the above problems in the prior art developing apparatus that utilizes one component magnetic toner.

Another object of this invention is to provide a developing apparatus in which even layers of toner having the desired thickness can be formed on a toner carrying member.

Still another object is to provide a developing apparatus in which a thickness limiting member for toner layers can be finely adjusted relative to a toner carrying member to form toner layers having the desired even thickness.

A further object is to provide an improved developing apparatus in which a toner carrying member can be always maintained relative to an image bearing member with a constant gap.

Still a further object is to provide an improved developing apparatus in which toner particles can be prevented from flying outwardly after they have not been utilized in development.

In order to accomplish these objects, this invention provides an developing apparatus comprising a developer of one component magnetic toner, means for supplying said developer, a movable developer carrying member having its surface for receiving the supplied developer thereon, fixed magnetic field-producing means disposed within said developer carrying member, and a thickness limiting member located close to said developer carrying member for controlling a layer of developer on said surface of said carrying member into a small thickness and opposed to a pole of said field producing means, characterized in that said thickness limiting member can be adjusted relative to said development sleeve and locked at a predetermined distance from said sleeve.

The sleeve has at its opposite ends bearings into which rollers or the like are fitted to provide a gap maintaining member so that said sleeve will be maintained relative to the latent image bearing member with a constant gap therebetween. Furthermore, a development vessel is swingably supported on a center axle of rotation which is positioned substantially on a line aligned with a direction of force from a driving gear.

These and other objects and advantages of this invention will now be apparent from reading the following detailed description in connection with the accompanying drawings.

DETAILED DESCRIPTION OF PREFERRED EMBODIMENTS

Embodiments of this invention will now be described in connection with the drawings.

Figure 1:
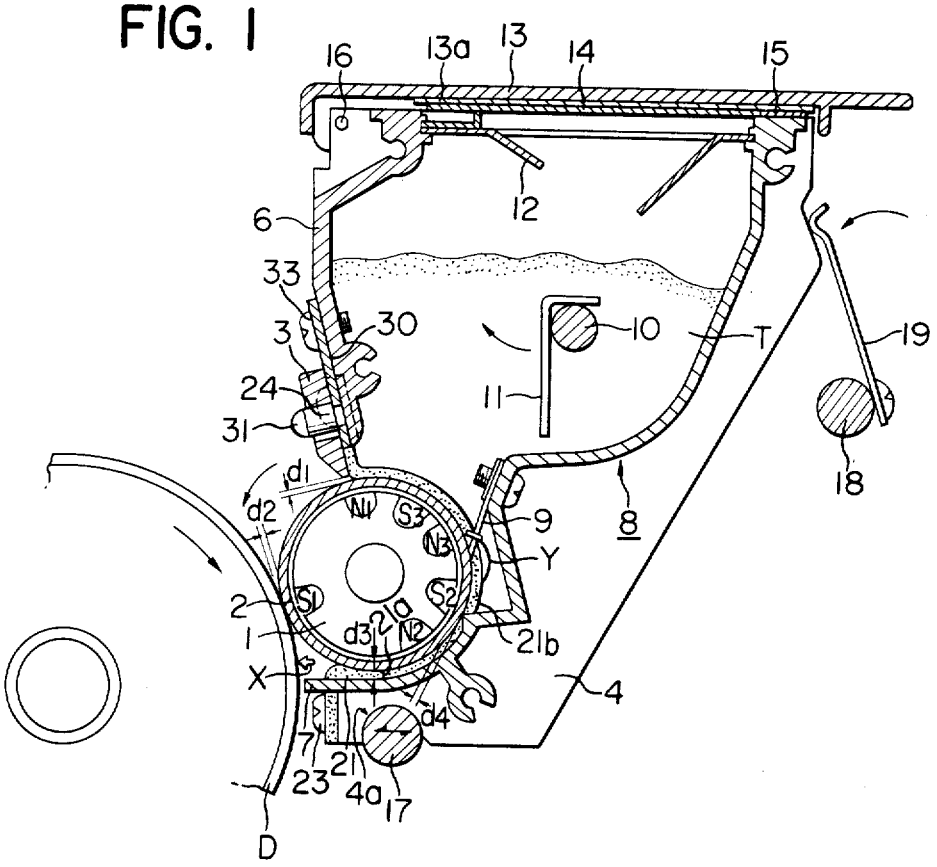
FIG. 1 is a sectional view showing an embodiment of a developing apparatus which is constructed in accordance with this invention.

FIG. 1 illustrates an embodiment of a development apparatus which is constructed in accordance with this invention. This developing apparatus comprises a magnet roll 1 fixed therein which is surrounded by a sleeve 2 of non-magnetic metal such as stainless steel. The sleeve 2 is rotated counterclockwise around the magnet roll 1 as shown in FIG. 1. A magnetic blade 3 of a magnetic material or magnet is located opposed to a cut pole $N_1$ in the magnet roll 1 and cooperates with this cut pole $N_1$ to apply a magnetic insulating toner T within a development vessel 8 to the sleeve 2 with an appropriate thickness when the sleeve 2 is rotated. The development vessel 8 is defined by side plates 4 and 5 (the side plate 5 being shown in FIG. 7), a forward stay 6 and a stay 7 for preventing the falling of toner. This mechanism for applying the toner to the sleeve will be described hereinafter. As the sleeve 2 is passed through a gap $d_2$ between a development pole $S_1$ and a photosensitive drum D, the applied toner on the sleeve 2 is transferred therefrom to the drum so that the toner will adhere to the area of the drum corresponding to a charged latent image, thereby forming a visuable picture. The details will be understood by referring to U.S. patent application Ser. Nos. 58,434 and 58,435 assigned to the present assignee. Under such a situation, the thickness of the applied toner is between 50μ and 100μ, and the gap $d_2$ is between 100μ and 330μ. In this connection, a gap $d_1$ is between 100μ and 500μ, preferably 240±30μ.

In the direction of rotation, a gap between the stay 7 and the outer periphery of the sleeve 2 is gradually decreased to form the narrowest gap $d_3$ at the bottom of the sleeve 2. The narrowest gap continues to the trailing edge of a felt element 21*a* which will be described hereinafter. This narrowest gap $d_3$ is preferably in the order of 1.3 to 2 millimeters such that the toner particles remaining on the sleeve 2 are easily passed therethrough. There is further an extremely narrow area $d_4$ formed at a path along which the toner T is collected into the development vessel 8. The extremely narrow area $d_4$ functions to prevent the falling of the toner T from the vessel 8, particularly the leakage of the toner in such a direction as shown by an arrow X when fresh toner is initially supplied into the development vessel 8 from the top thereof. Preferably, a magnetic pole as shown by $S_2$ is located within the magnet roll 1 at a position that corresponds to the extremely narrow area $d_4$. This is because the applied toner particles will stand at the area of the magnetic pole $S_2$ to form brushes so that the toner can be relatively prevented from leaking through the extremely narrow area. For this purpose, it is preferred to form the area $d_4$ with as small dimension as possible. However, an actual dimension of the area $d_4$ is on the order of 0.7 to 1.3 milimeters such that the unused toner particles will be easily passed therethrough.

If the clearance between the sleeve 2 and the stay 7 is continuously formed from the gap $d_3$ to the area $d_4$ with the same dimension as in the area $d_4$, that is, 0.7 to 1.3 milimeters, the toner particles fall down on the stay 7 at non-magnetic areas between the poles $S_1$ and $N_2$; $N_2$ and $S_2$ to grow gradually into such an agglomeration that is connected with the toner particles on the sleeve 2. Such an agglomeration will interrupt the feeding of toner in the direction of rotation of the sleeve 2. Finally, this results in the leakage of toner in the direction X. It is therefore preferred to form the extremely narrow area $d_4$ only at a portion of the path. This will be described in details hereinafter.

The toner which has now been passed through the area $d_4$ is scraped off from the surface of the sleeve 2 by means of a cleaner 9 which may be a leaf spring made of phosphor bronze, stainless steel or the like. The scraped toner T is passed through the aperture of the cleaner 9 in such a direction as shown by a capital letter Y. This is accomplished by a combination of the magnetic force in the pole $N_3$ with the thrust of the toner which is being scraped off from the sleeve 2.

A shaft 10 includes wires 11 mounted thereon which are rotated clockwise to agitate the toner T. The development vessel 8 serves as a hopper for supplying the toner, the hopper having an inner funnel-shaped lid 12. The development vessel also includes an outer lid 13 to which an iron plate 13*a* is attached. The iron plate 13*a* is adapted to be attracted by magnetic rubber elements 14 and 15 which are mounted on the development vessel 8. The outer lid 13 is pivotably connected around a shaft 16.

As seen from the foregoing, the developing apparatus of this invention is incorporated into the development vessel 8 to form a development assembly. This assembly is inserted into the machine through the top thereof and supported therein by a shaft 17 with which recesses 4*a* in the side plates 4 and 5 are engaged. It has been customary that such an assembly was inserted into the machine in a direction perpendicular to the plane of FIG. 1. This is because a driving connection can be easily obtained between the developing apparatus and the drive of the machine. In the embodiment of the developing apparatus constructed according to this invention, however, the gap $d_2$ between the photosensitive drum D and the development sleeve 2 must be maintained constant, for example, $300\pm30\mu$ as will be described hereinafter. Considering the eccentricity of the drum (generally, about $70\mu$) and the eccentricity of the sleeve (about $10\mu$), the gap $d_2$ will be varied over two times said eccentricities, that is, about $160\mu$ beyond the acceptable range, $\pm30\mu$ if the developing apparatus is set within the machine as in the prior art. The machine can be designed in such a manner that the eccentricity of the sleeve can be ignored. However, it is difficult to ignore the eccentricity of the drum since it has a large diameter and irregular thickness due to photosensitive and insulating layers applied thereto. It must be also considered that the pipe-shaped drum is supported at its ends by flanges which may have their own eccentricities. In accordance with this invention, the development assembly can be inserted into the machine through the top thereof and rotatably supported by the shaft 17 in the machine with the recesses 4*a* of the side plates being fitted thereover so that the sleeve of the developing apparatus will be maintained relative to the surface of the drum with a constant gap therebetween. On the other hand, the development vessel is suitably urged counterclockwise by means of a leaf spring 19 on a shaft 18 which is rotated counterclockwise. The recesses 4*a* in the side plates are engaged by the shaft 17 with some play, for example, 0.2 to 0.3 milimeter so that the developing apparatus can be somewhat moved in such a direction as shown by a double-headed arrow in FIG. 1 to engage the photosensitive drum D evenly with a sleeve including rollers 20 shown in FIG. 2.

Figure 2:
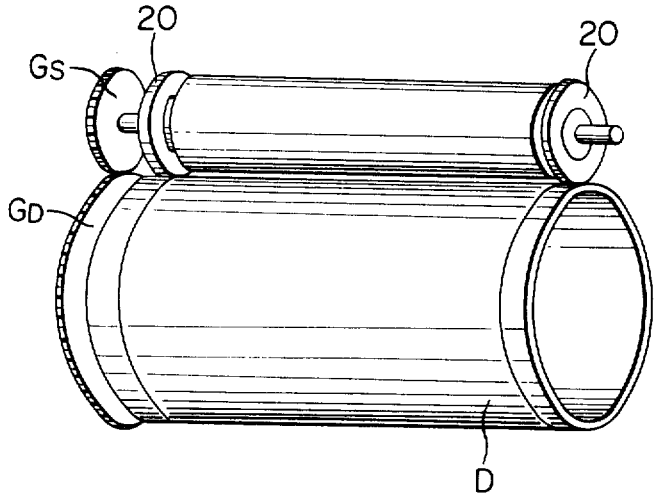
FIG. 2 is a perspective view showing a positional relationship between a sleeve and a photosensitive drum.
Figure 3:
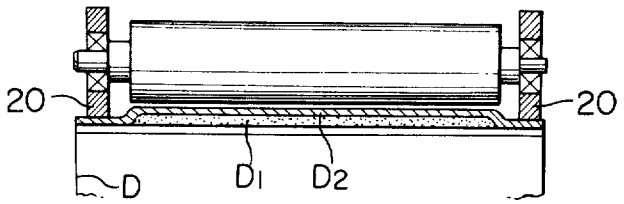
FIG. 3 is a side elevational view showing, partly in section, the structure in FIG. 2.

The roller 20, which is a gap maintaining member, can be engaged by the ends of the photosensitive drum D as shown in FIGS. 2 and 3 by the fact that the gap $d_2$ is provided between the photosensitive drum D and the sleeve 2. The development assembly can be moved around the shaft 17 to accommodate itself to the eccentricity of the photosensitive drum D.

The photosensitive drum D includes a photosensitive CdS layer $D_1$ applied to the outer periphery thereof and an insulating layer $D_2$ covering said CdS layer $D_1$. The insulating layer $D_2$ is contacted directly with the outer periphery of the photosensitive drum only at the opposite ends thereof. The rollers 20 contact with the end portions of the photosensitive drum which are applied only by the insulating layer $D_2$. This avoids damage to the insulating layer $D_2$ over the CdS layer $D_1$ since the CdS layer is relatively soft. Each of the rollers 20 is preferably made of ultra-high-molecular-weight polyethylene since such a material is durable and has a property of lessening damage to the insulating layer on the photosensitive drum D. It is to be understood that each roller 20 has its radius equal to a total dimension which is obtained by adding the radius of the sleeve 2 to the thickness of the CdS layer $D_1$ and the gap $d_2$.

In this invention, it must be considered that any unexpected force can be exerted on the whole developing assembly if the developing apparatus is carelessly driven since the development assembly is somewhat swingably supported on the shaft 17. When the development assembly is laterally inserted into the machine through the side thereof and the development sleeve is driven through the coupling fixed on the side of the machine as in the prior art, the development assembly can be firmly supported within the machine so that the assembly will not be undesirably moved in driving the development sleeve. Therefore, the prior art has not the above problem as in this invention. This problem can be solved in this invention by such a design as will be described with reference to FIG. 4.

In the illustrated embodiment of this invention, the sleeve 2 is rotated, at the closest position relative to the photosensitive drum D, in the same direction and substantially at the same peripheral speed as in the photosensitive drum D. Exactly speaking, the sleeve 2 is rotated at about 97% to 98% of the peripheral speed of the photosensitive drum D. This is determined by considering the fact that the actual peripheral speed in the sleeve 2 corresponds to that of the photosensitive drum D under such a condition that the peripheral speed in the tips of brushes defined by the applied toner particles is added by the increment of speed in the rolling brush bristles. Thus, the toner particles can be accurately moved electrostatically to any charged latent image on the photosensitive drum D. In other words, the speed of the toner particles on the surfaces of the brushes formed on the sleeve becomes equal to the peripheral speed of the drum D by rotating the sleeve at its peripheral speed somewhat smaller than that of the drum D. This can be easily accomplished, as shown in FIG. 2, in such a manner that a sleeve gear Gs mounted coaxially on the sleeve 2 is engaged by a drum gear Gd mounted coaxially on the photosensitive drum D.

Figure 4:
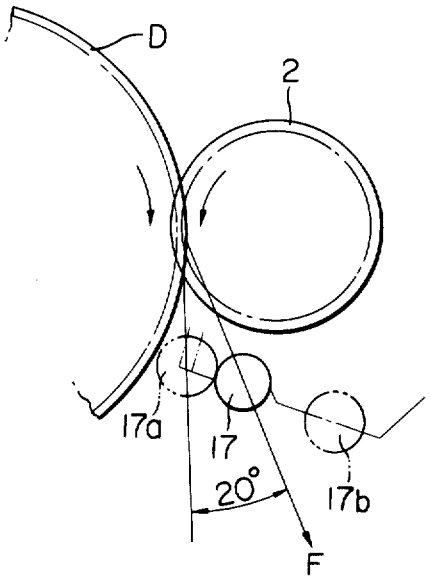
FIG. 4 is a schematic view illustrating the positional relationship of FIG. 2.

In such an arrangement, when the shaft 17 is disposed at such a position as shown by 17*a* in FIG. 4, the whole development assembly may be moved away from the drum D under a force F based on the pressure angles in the gears. When the shaft 17 is disposed at a position 17*b*, the whole development assembly may be forced against the drum D under the same force F so that the sleeve rollers 20 will be pressed against the drum D under different pressures. This results in the damage of insulating layer $D_2$. Furthermore, the rollers 20 may be separated from the photosensitive drum D to increase the gap $d_2$ between the photosensitive drum D and the sleeve 2 so that the development cannot be accomplished. Particularly, in the illustrated embodiment of this invention, felt elements 21 and 22 are pressed against the sleeve 2 to prevent the toner from leaking out of the outer end portions thereof as will be described with reference to FIG. 8, so that the force F tends to be increased under the friction between the felt elements and the sleeve. In an experiment in which the shaft 17 is located at the position 17*b* in FIG. 4, it has been found that the development assembly is rotated counterclockwise around the shaft 17*b* under a moment based on the force F to press the sleeve rollers 20 violently against the photosensitive drum D so that it is damaged by the rollers 20.

In accordance with this invention, the shaft 17 is disposed on a line which extends at 20 degrees to a tangent in the engagement between the gears Gd and Gs. This is because the teeth of a general gear are cut with 20 degrees of pressure angle. If a pressure angle of 14.5 degrees is used, this angle is of course selected as an angle included between the above line and the tangent. JIS (Japanese Industrial Standard) advises 20 degrees of pressure angle in gears. In such an arrangement, the force F based on this pressure angle passes through the shaft 17 so that the development assembly will not be influenced by the force F no matter how large it is. This is because no moment is produced to rotate the development assembly. Thus, the development assembly of this invention can be set in the machine more easily than in the prior art merely by inserting the assembly into the machine through the top thereof and pressing the same against the photosensitive drum D under the influence of the leaf spring 19 (FIG. 1). Furthermore, if the center of gravity in the development assembly is positioned on the left hand of the shaft 17 as viewed in FIG. 1, the development assembly can be pressed against the photosensitive drum D under gravity without the leaf spring 19.

Figure 5:
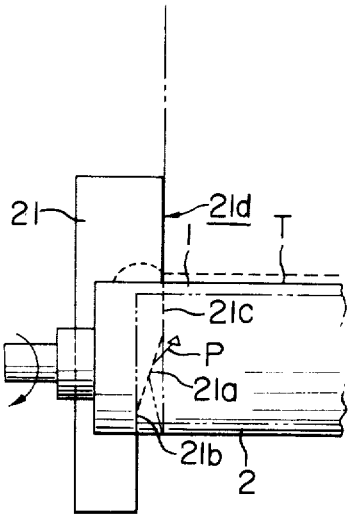
FIG. 5 is a front view showing part of the end of the sleeve.
Figure 6:
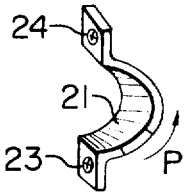
FIG. 6 is a perspective view showing a felt element in the end of the sleeve.
Figure 8:
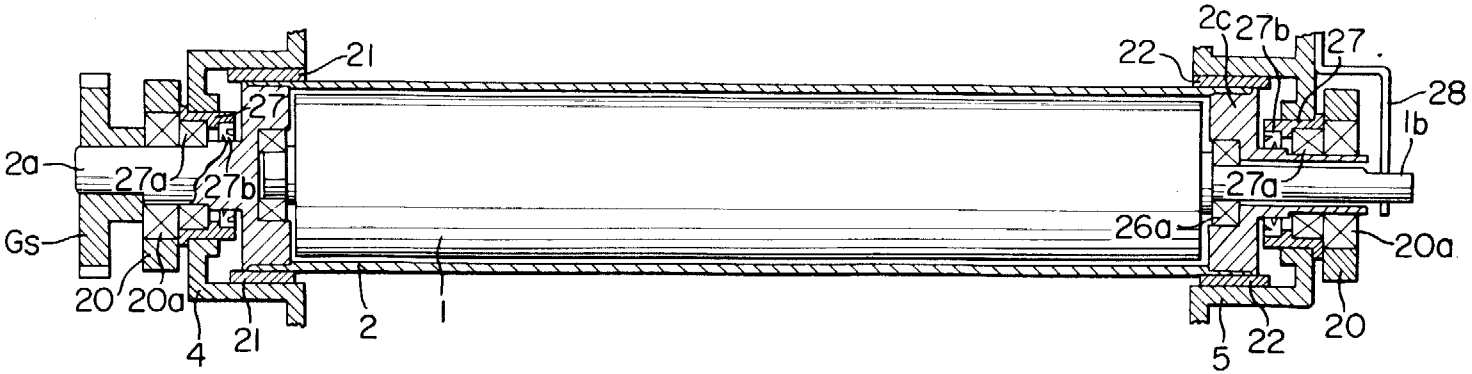
FIG. 8 is a longitudinal section of the sleeve shown in FIG. 1.

As seen from FIGS. 1 and 8, the felt elements 21 and 22 are disposed to contact with the end portions of the sleeve 2 to prevent the toner particles from leaking. As shown in FIGS. 1, 5 and 6, each of the felt elements is positioned to surround a half of the outer periphery of the sleeve 2 and contact therewith under a suitable pressure. The felt element is also positioned in a gap (for example, 2 milimeters) between each end of the sleeve 2 and each side plate. In this case, the felt element is selected to have 2.5 milimeters of thickness so that it will be pressed against the side plate by its own elasticity.

Referring to FIGS. 5 and 6, if the felt element 21 or 22 is not present, the toner particles are accumulated in a heap at the end of the sleeve 2 as shown by a broken line in FIG. 5. This results from the fact that a magnet 1 disposed within the sleeve 2 has its strong magnetic field at the ends thereof. This problem cannot be overcome even by chamfering the ends of the magnet or reducing the diameter at the ends thereof. When the conventional conductive, magnetic toner is applied on the sleeve with a relatively large thickness, for example, 1 milimeter or more to scrape it, the above problem can be ignored. In this case, the toner can be evenly applied on the sleeve to such a position as spaced from the end of the internal magnet by about 15 milimeters. The problem cannot be ignored, however, when the toner is applied to the sleeve with its smaller thickness (for example, 30μ to 0.5 mm) by blade means such as a magnetic blade to use the applied toner in development. Namely, said heap of the toner may be appeared on a developed picture in a strip, or an agglomeration of the toner may be produced between the latent image forming member and the sleeve. Such an agglomeration tends to damage the latent image forming member and the sleeve so that the toner will not be applied to the damaged areas of the forming member and sleeve. In accordance with this invention, the felt elements 21 and 22 of Teflon (Trade Mark) prevent the toner from moving to the ends of the sleeve so as to form said heap. For this purpose, the Teflon felt elements surround the sleeve 2 at such a position as spaced inwardly from the ends of the internal magnet 1. As the sleeve is rotated, furthermore, the toner particles tends to be attracted and moved to the ends of the sleeve under the influence of the strong magnetic field therein after the toner particles have been passed through the magnetic blade 3 (FIG. 1) as shown by a one-dot-dash line in FIG. 5. In accordance with this invention, as shown in FIGS. 5 and 6, each felt element 21 or 22 includes a slant portion 21*a* formed therein in such a position that the toner particles passes therethrough after the development has been completed. The toner particles moving to the ends of the sleeve can be thus guided along the slant portion in a direction P. The felt element also includes an upper straight portion 21*d* formed therein which is different from the slant portion extending from a point 21*b* to another point 21*c*. The upper straight portion of the felt element is flush with each of the side plates 4 and 5 to form no gap therebetween from such a position as being engaged by the magnetic blade to the area of gap $d_4$. This prevents the toner particles from leaking from the development vessel 8. The point 21*c* of the felt element may be positioned somewhat below the gap $d_4$. The felt portion 21*c* must not be positioned at such a location as spaced inwardly form the corresponding side plate since the toner particles are moved from the development vessel through the resulting gap under the action of air flow in opening and closing the lid 13 when the development vessel becomes substantially empty. The felt elements may be of any other material, for example, wool felt. It is preferred, however, that the felt elements is made of Teflon (Trade Mark) because it is superior to other materials such as wool felt in that the toner particles can be prevented from adhering to the surface of the sleeve by heat due to the friction between the felt elements and the sleeve. In FIG. 6, reference numerals 23 and 24 designate screws for attaching the felt elements to the forward stay 6 and side plate 4.

Figure 7:
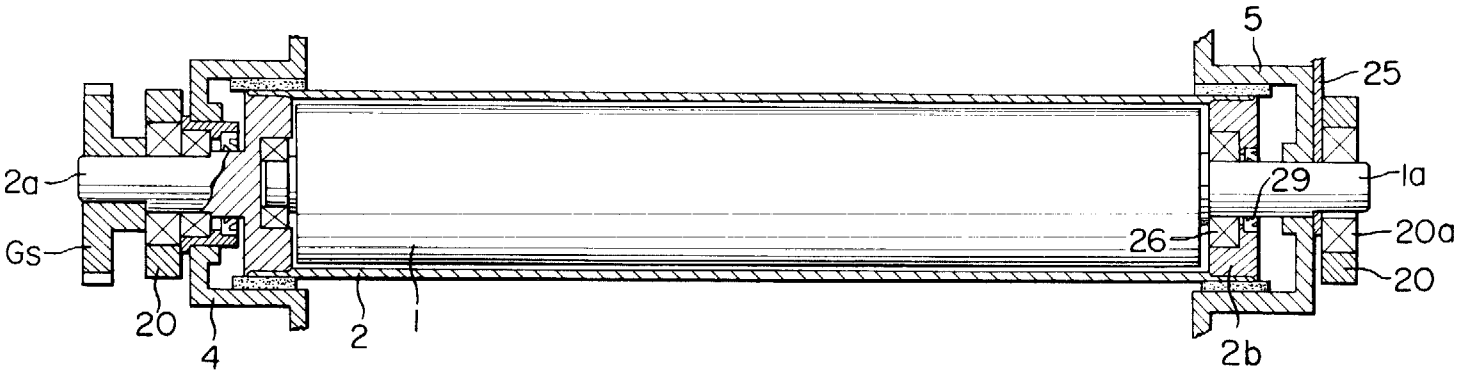
FIG. 7 is a longitudinal section showing an example of a sleeve which is unsuitable for this invention.

FIG. 7 shows an example of a sleeve which is not suitable for this invention. The unsuitable sleeve 2 includes a sleeve shaft 2*a* which is press-fitted or screwed into the left end of the sleeve 2 and another sleeve shaft 2*b* which is press-fitted or screwed into the right end of the sleeve 2. The sleeve 2 also includes a magnet roll 1 located therewithin which has a shaft 1*a* extending outwardly through the sleeve shaft 2*b* and being fixed to the side plate 5 by means of a clamp 25. In such an arrangement, the left sleeve roller 20 is mounted on the sleeve shaft 2*a* so that the sleeve will be less influenced by the eccentricity. However, the right sleeve roller 20 is mounted on the magnet shaft 1*a* which is a separate part from the sleeve so that the sleeve will be undesirably influenced by the eccentricity in a bearing 26 and the sleeve shaft 2b.

FIG. 8 shows a preferred sleeve applied suitably to this invention which includes a prolonged sleeve shaft 2c supported rotatably in the side plate 5 by means of a bearing 27 as in the left sleeve shaft. The right sleeve roller 20 is mounted on that portion of the shaft 2c which is positioned outside. The magnet shaft 1b is similarly prolonged so that it can be fixed to the side plate 5 by means of a clamp 28. Thus, the sleeve rollers 20 can be mounted on the sleeve shafts 2a and 2c formed integrally with the sleeve 2 substantially without any influence of eccentricity. It is noted that the sleeve rollers 20 are so disposed outside the development vessel, that is, the side plates 4 and 5 that the ball bearings 20a of the rollers 20 will not be deteriorated by the flying toner particles from the development vessel.

In such an arrangement, a sealing element 29 as shown in FIG. 7 is not required between the magnet 1 and the sleeve 2 because a bearing 26a is not exposed in the development vessel which is filled with the toner. This also provides such an advantage that a friction can be reduced between the magnet and the sleeve. Moreover, while the structure of FIG. 7 critically requires the bearing 20a of the right roller 20, the structure of this invention as shown in FIG. 8 may include an alternative roller 20 which is formed integrally with the sleeve 2 without the bearing 20a. Even if the bearing 20a becomes immobile, the outer periphery of the sleeve, exactly speaking, that portion of the sleeve which the radius thereof is increased by 300μ, is moved at the same speed as the peripheral speed of the photosensitive drum D. This corresponds to the external diameter of the roller 20. In other words, the drum and roller can be rotated at such a location that corresponds to the above radial distance. This will now be described concretely as follows: The drum D has a diameter of 80 milimeters and includes the drum gear Gd having 80 teeth mounted thereon. The sleeve 2 has a diameter of 32.4 milimeters and includes the sleeve gear Gs having 33 teeth mounted thereon and engaged by the drum gear. If the roller 20 has a diameter of 33 milimeters, the roller is completely rotated at each revolution of the sleeve. Therefore, the roller will be rotated at the same peripheral speed as that of the photosensitive drum D even if another heavily loaded bearing with rubber shield is used instead of the bearing 20a of the roller. In the structure of FIG. 7, any slippage can be produced between the photosensitive drum D and the rollers 20 as the load on the bearing 20a is increased. This results in wear in the rollers 20 or the photosensitive drum D.

Further, the bearing 27 is formed by connecting a bearing portion 27a and sealing element 27b integrally with each other. Therefore, any clearance between various parts can be reduced, and an accuracy in assembling can be improved.

Figure 9:
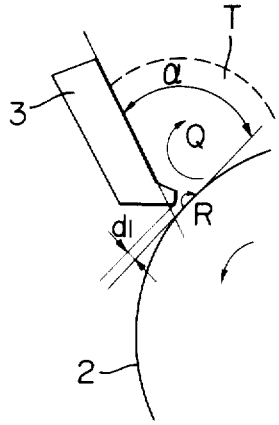
FIG. 9 is a view showing, partly in section, the prior art sleeve.
Figure 10:
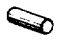
FIG. 10 is a perspective view of a toner agglomeration.

The behavior of the toner particles around the sleeve will now be described hereinbelow. FIG. 9 shows the behavior of the toner in the prior art in which the toner particles are moved substantially in a direction Q as the sleeve 2 is rotated. If an angle (mounting angle of the blade 3) is smaller than 90 degrees, the toner particles on the rotating sleeve 2 collide against the magnetic blade 3 and then move in the direction Q so that the toner particles will tend to agglomerate under unnecessary forces. Particularly, if there is a small acute angle as shown in FIG. 9, the toner particles are moved in a small turn in a direction R so that they will be rolled violently under a large agglomerating force to form a hardened toner agglomeration like a pencil lead (see FIG. 10). Such a hardened toner agglomeration tends to become jammed in the gap $d_1$ between the sleeve 2 and the blade 3 and thereby arrest the passage of toner so that it will not be applied to the surface of the sleeve 2.

Figure 12:
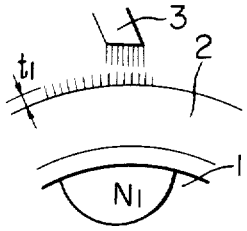
FIG. 12 is a view illustrating part of FIG. 11.

In order to overcome the above problem, the magnetic blade 3 of this invention has its leading edge positioned substantially parallel to the sleeve 2, that is, the operating surface thereof and/or in such a manner that the leading edge of the blade 3 is gradually diverged from the surface of the sleeve 2 in the rotational direction thereof. This will now be described in detail with reference to FIGS. 11 and 12. An obtuse angle α larger than 90 degrees is included between the surface of the sleeve 2 and the end face of the magnetic blade 3 which is faced to the toner. Thus, the radius of gyration of the toner particles in the direction Q can be increased to avoid any agglomeration of toner. It is preferred that the leading edge of the blade has a thickness t of 0.3 to 1 milimeters. If the thickness t is smaller than the above value, the toner is unevenly applied to the sleeve along the length thereof. On the other hand, if the thickness t is larger, the toner is unevenly applied to the sleeve in the circumferential direction thereof.

Supposing that the gap $d_1$ is of $240\mu \pm 30\mu$, and the pole $N_1$ is of 800 gausses in its surface density of magnetic flux, the brushes of magnetic toner connect between the sleeve 2 and the magnetic blade 3 at the leading edge thereof. In the area other than the leading edge of the blade, the toner brushes are cut at such a position that the magnetic force in the blade 3 stands against that in the magnet 1. Under such situations, the toner particles will be applied to the surface of the sleeve 2 with a thickness $t_1$ which is between about 50μ and 100μ. As the sleeve 2 is rotated, the toner particles applied thereto are transferred to the development pole $S_1$ in which they are accumulated somewhat in a heap. However, the heap is extremely low compared with the gap $d_2$ of $300\mu \pm 30\mu$, normally, of about 10μ or slightly more. It is apparent that the thickness of the applied toner is smaller than the gap between the sleeve and the drum. Thus, the toner particles are magnetically forced to move between the sleeve and drum toward the charged latent image on the drum so that development will be accomplished. If any charged image is not present on the drum, the applied toner particles are merely rolled on the sleeve at the pole $S_1$ without any turbulence and passed through the gap $d_2$. As the sleeve 2 is further rotated, the applied toner particles thereon are moved downwardly.

In a development process where the toner particles are magnetically transferred in the space between the drum and the sleeve to adhere to the latent image on the drum, an alternating voltage can be applied between the sleeve and photosensitive drum to obtain a developed image having higher harmony with no fog. This is accomplished by flying the toner particles at once to the surface of the drum under an electric field toward the drum and thereafter moving back the flown toner particles to the sleeve from that area of the drum which there is no latent image or less latent image charge, under an electric field away from the drum. The above alternating voltage includes an electric current combined by alternating and direct currents, for example. In this case, the toner is preferably of a high resistance or insulation property to enable the toner itself to maintain the charge thereof. This development process characterized by the alternating voltage is described in detail in U.S. patent application Ser. Nos. 58,434 and 58,435 which are assigned to the present assignee.

Figure 11:
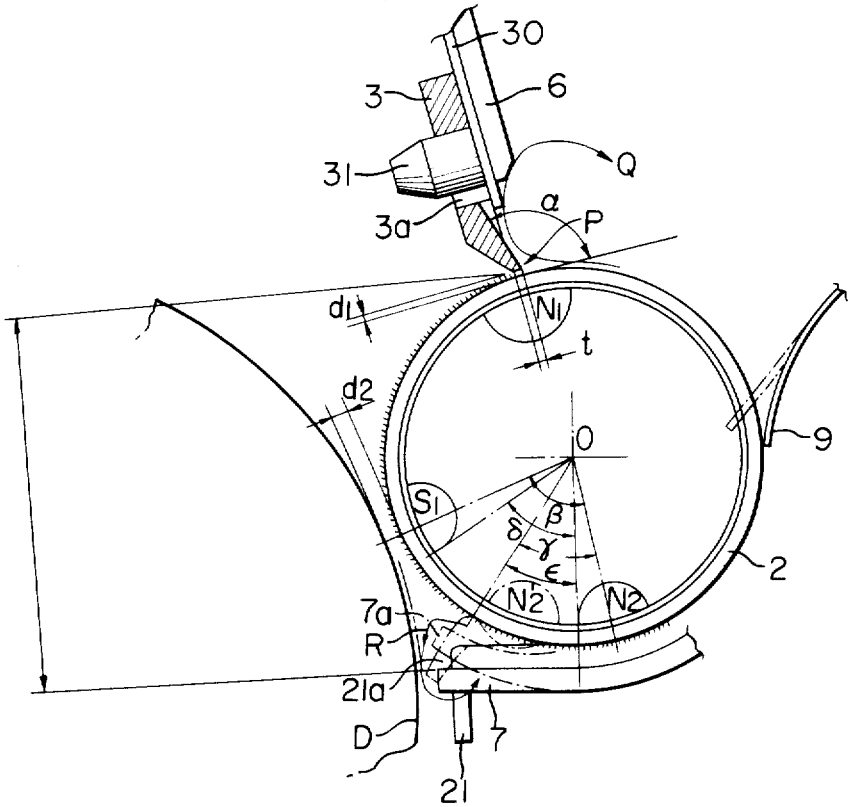
FIG. 11 is a cross-section of the sleeve shown in FIG. 1.

As shown in FIG. 11, the stay 7 for preventing the toner from falling extends substantially horizontally toward the photosensitive drum D. In the prior art, a similar stay extended along part of the outer periphery of the sleeve 2 as shown by a one-dot-dash line *7a* in FIG. 11. This is because it had been considered that the toner falling from the sleeve 2 may be easily caught by such a curved stay *7a*. It is actually found that a substantial amount of the toner tends to be dispersed beyond the curved stay *7a* as shown by an arrow R so as to adhere to the outer surface thereof under the influence of the magnetic pole $N_2$ while the toner particles are rolled or flown between the sleeve and drum at the development pole $S_1$. The distance between the development pole $S_1$ and the pole $N_2$ must be wide as will be described hereinafter so that the sleeve portion therebetween will be covered by weaker magnetic force to cause the toner particles to fall down easily by vibration or the like. When a toner lump of a substantially large size (about 100 to 200$\mu$) is produced or transferred from the development vessel near the development pole $S_1$, such a toner lump is substantially retained therein under the influence of the development pole $S_1$ and sometimes falls down. Even if the large toner lump is further transferred from the area of the development pole $S_1$, it also falls down at that area which there is no magnetic force or less magnetic force. The falling toner lump tends to jam between the curved stay *7a* and the sleeve. Particularly, at the area of the sleeve where there is a pole in the internal magnet, the applied toner particles can be accumulated in a heap to increase the tendency of jamming because such a heap is easily connected with a similar toner heap which is accumulated on the curved stay *7a* by falling. If a similar accumulated toner heap is produced on each end of the sleeve, it tends to jam at the slant portion of the felt element. When the slant portion of the felt element is jammed by the toner lump, the following toner particles are prevented from moving in the desired direction to be accumulated therein so that they will be overflowed beyond the leading edge of the curved stay in such a direction as shown by the capital R. For avoiding this, this invention provides the stay 7 extending substantially in a horizontal direction toward the photosensitive drum D as described hereinbefore.

In accordance with this invention, the sealing elements 21 and 22 of felt material are disposed along the stay 7 for avoiding the falling of the toner and contacted with the sleeve 2 substantially at the bottom thereof. The bottom position is spaced substantially inwardly from the edge of the stay 7 so that the toner particles cannot be easily accumulated beyond the edge of the stay 7 even if they are agglomerated therein. In the prior art, however, when the stay *7a* is disposed along the sleeve as shown by the one-dot-dash line in FIG. 11, each of the sealing elements cannot help disposing as shown by 21*a* for sealing between the stay and the corresponding side plate. As a result, the sealing element is contacted with the sleeve 2 in a position spaced substantially outwardly from the stay *7a* so that the toner particles accumulated therein will leak out easily. Furthermore, the toner particles falling down from the sleeve tend to be deposited transversely (in the longitudinal direction of the sleeve) under the presence of the toner agglomeration which has been already formed at the same location. These deposited particles arrest the applied toner particles on the rotating sleeve which should be returned to the development vessel.

An angular relationship between the poles $S_1$ and $N_2$ will now be described hereinbelow. If the angle between the poles $S_1$ and $N_2$ is small, that is, the pole $N_2$ is located at such a position as shown by $N_2'$, the applied toner particles are formed into a higher heap thereat as shown by a two-dot-dash line in FIG. 11 while they are rolled. As a result, the toner particles on the higher heap tend to fly therefrom. If the pole $N_2'$ is located at a position adjacent to the outer edge of the stay 7, the flying toner particles are more easily dispersed beyond the outer edge of the stay 7.

In the illustrated embodiment of the development assembly which is constructed according to this invention, the poles $S_1$ and $N_2$ have their opposite polarities and are spaced away from each other by an angle $\beta$ of 70 degrees or more. Moreover, the pole $N_2$ is spaced away from the outer edge of the stay 7 by an angle $\gamma$ of 30 degrees or more. If the angles $\beta$ and $\gamma$ are smaller than the above values, the top and bottom surfaces of the stay 7 will be both covered by the dispersed particles of toner. Particularly, when the angle $\beta$ is about 50 degrees or less, a violent dispersion of toner will be produced.

The opposite polarities in the poles $S_1$ and $N_2$ are provided for the reason that, if these polarities are identical with each other, the toner particles tend to fall down from the sleeve under the influence of the magnetic repelling force at an intermediate point between the poles.

Figure 13:
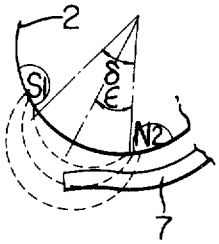
FIG. 13 is also a view illustrating part of FIG. 11.

While the angles between the poles are represented by those included between the lines which pass through the centers of the poles, they can be indicated by lines which pass through the edges of the poles. Since the toner particles begin to be rolled and form brushes of toner at the edges of the poles, an angle $\delta$ between the adjacent edges of the poles $S_1$ and $N_2$ is preferably of 50 degrees or more to obtain good results if each of the above edges of the poles are defined as a location having magnetic force a half that of the magnetic force at the above line which passes through the center of the corresponding pole. See FIG. 13. In this case, an angle $\epsilon$ included betwen the outer edge of the stay 7 and the corresponding edge of the pole $N_2$ is required to be of 20 degrees or more.

A manner in which the magnetic blade 3 is mounted on the sleeve 2 will now be described herein. In the illustrated embodiment of this invention, the gap between the magnetic blade 6 and the sleeve 2 is extremely small, 240$\mu$ so that it will be readily jammed by foreign matters such as dust, clips, toner agglomeration or the like. The development assembly can be easily cleaned by removing the blade 3 and/or the sleeve 2 therefrom. The removing and mounting of these members must be readily effected with no adjustment. The development assembly of this invention can be easily adjusted in assembling and also cleaned by removing the components and then mounting them under the following conditions.

In sleeve:

(1) The felt sealing elements 21 and 22 (FIG. 8) are of a material having its slight elasticity and extend along a half of the outer periphery of the sleeve. Even if the sealing felt elements extend slightly beyond a half of the outer periphery of the sleeve, the sleeve can be readily removed from the felt elements in such a direction that the felt elements are opened.

(2) The distance between the stay 7 and the magnetic blade 3, which is shown by 1 in FIG. 11, must be larger than the diameter of the sleeve 2.

Figure 14:
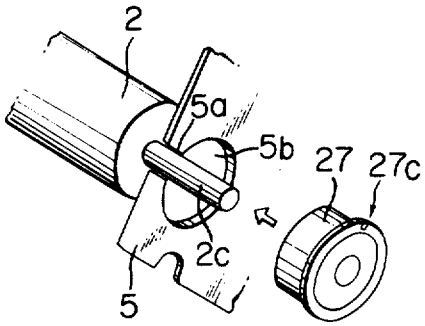
FIGS. 14 and 15 are perspective views showing the sleeve of FIG. 8 at its end.

(3) Each of the side plates includes a slit having a width through which the shaft on the corresponding end of the sleeve can be passed and a circular aperture which is connected with said slit and has a diameter larger than the width of the slit. The shaft of the sleeve is adapted to be received rotatably in the circular aperture through a bearing. Referring to FIG. 14, the shaft 2c of the sleeve 2 is received in the circular aperture 5b through the slit 5a of the side plate 5 and thereafter supported by the bearing 27 which has been inserted into the circular aperture 5b. The bearing 27 is marked as by 27c to be reset at the same position as in removing so that the same gap $d_2$ will be always obtained between the sleeve 2 and the magnetic blade 3 even if the bearing 27 has large eccentricity.

If the magnet shaft is mounted directly on the side plate at the non-driven side as shown in FIG. 7, a stepped shaft may be used instead of the magnet shaft without any bearing.

In such an arrangement, the sleeve can be easily removed from the development assembly by disengaging the bearings from the shafts. It is apparent that any member may be used to engage respectively with the outer periphery of the magnet shaft 1a and the inner periphery of the circular aperture 5b in the side plate 5, instead of the bearing if the sleeve includes the sleeve shaft 2a at one end and the magnet shaft 1a at the other end.

Figure 15:
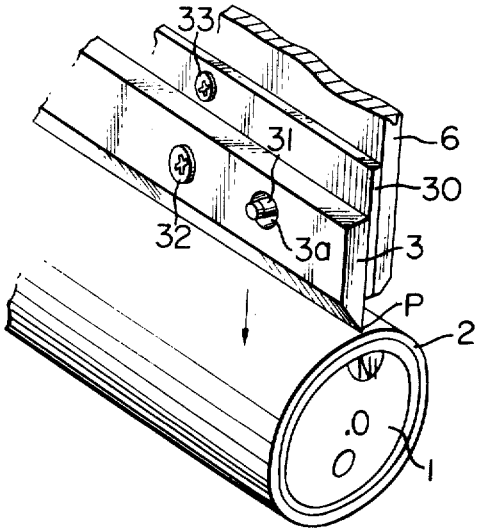
Figure 16:
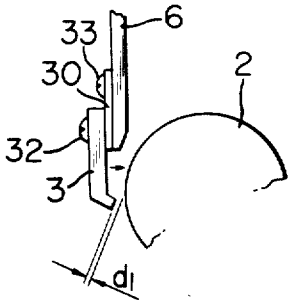
FIG. 16 is a side view of FIG. 15.

In the blade:

Referring to FIGS. 11 and 15, dowels (pins) 31 are clamped to an adjusting plate 30 for mounting the blade and fitted into apertures 3a of the magnetic blade 3 with some play. This play may be zero, but is preferably of about 1 milimeter considering the simplicity in assembling and disassembling. However, a gap based on the play must be always produced under the dowels by attracting the blade 3 magnetically to the magnetic cut pole $N_1$ or by gravity when the blade is not magnetic. Namely, the upper portion of each dowel 31 must be contacted with the upper portion of the corresponding aperture 3a of the blade 3 to connect the blade firmly with the adjusting plate 30. The blade 3 is initially retained loosely by screws 32. In order to obtain the gap (240 $\mu$) between the sleeve 2 and the magnetic blade 3, the adjusting plate 30 is moved upwardly to contact the upper portion of each dowel 31 naturally with the upper portion of the corresponding aperture 3a since the blade 3 is magnetically attracted by the cut pole $N_1$. After the desired gap of 240 $\mu$ has been obtained, the screws 32 and 33 are tightened. It is preferred that the edge P of the blade is moved directly toward the center O of the sleeve and the screws 32, 33 and dowels 31 extend in a direction perpendicular to the movement of the blade. If a structure shown in FIG. 16 is used, gaps are produced between the magnetic blade 3 and the adjusting plate 30 and between the latter and the forward stay 6 since the adjustment is effected under such a condition that the screws 32 and 33 are tightened. When the screws 32 and 33 are tightened to reduce these gaps to zero, the gap $d_1$ will be also reduced undesirably.

In accordance with the above arrangement of this invention, the magnetic blade 3 is moved merely parallel to the surface of the sleeve so that the gap $d_1$ will not be influenced. The magnetic blade 3 can be removed only by loosening the screw 32. At reset, the blade is attracted by the cut pole $N_1$ automatically to position the gap 3a below the dowel 31 so that the screw 32 may be tightened as it is. It is further apparent that the screws 32 may be tightened to the forward stay 6 instead of the adjusting plate 30. In such an arrangement, the sleeve 2 and blade 3 can be separately removed without any adjustment and the like to clean the gap $d_1$ therebetween.

A manner in which fresh developer is supplied to the development vessel will now be described hereinbelow.

Figure 17:
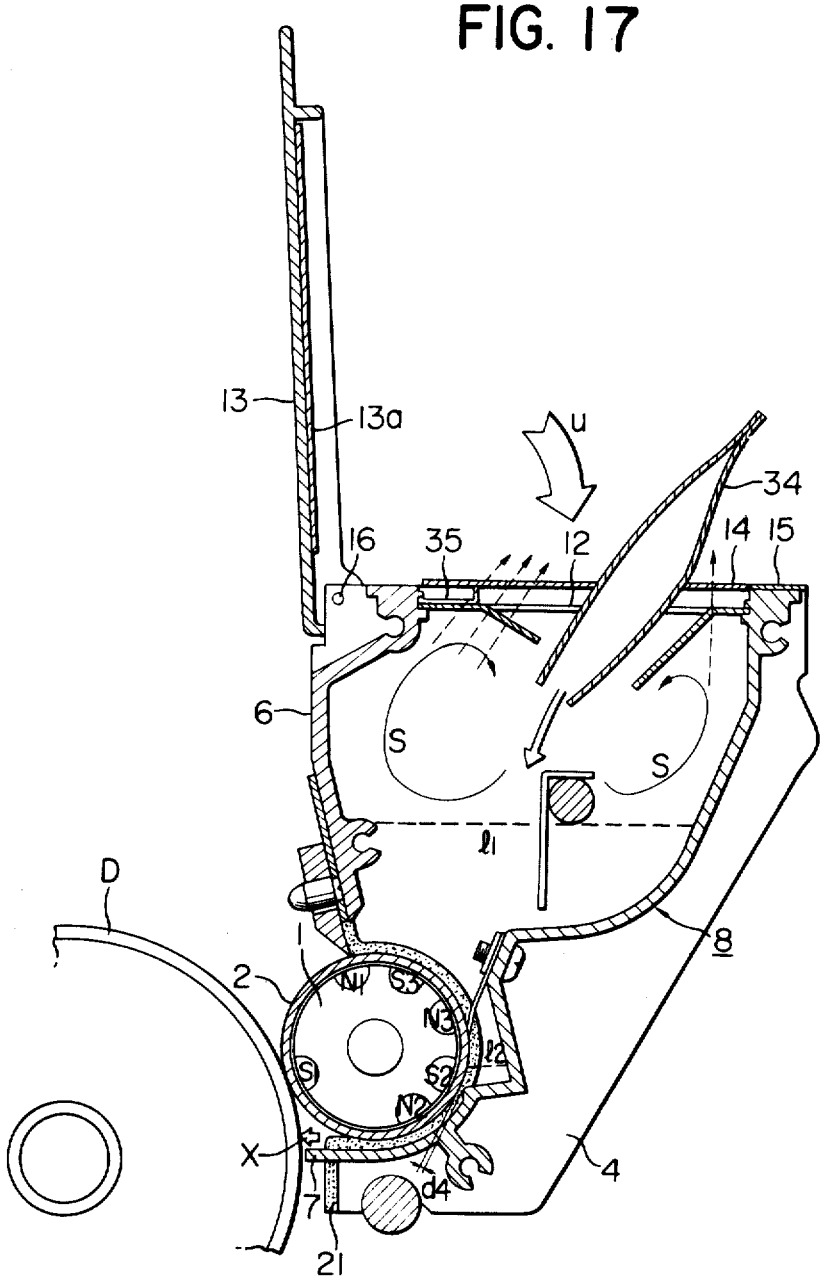
FIG. 17 is a sectional view showing an outer lid in the developing apparatus of FIG. 1 at its open position.

The lid of the development vessel has been generally hinged on the machine considering its light operation and cost. Referring to FIG. 17, a bag 34 containing fresh developer is partly cut and positioned bottom up for supplying the fresh developer to the development vessel 8. If the inner lid 12 is not provided, the supplied toner particles rebound at the bottom of the vessel 8 to fly up as shown by arrows of broken lines so that the top and inner walls of the machine will be contaminated. Moreover, if the top opening of the vessel is too large, the developer is roughly supplied to the machine by an operator.

Figure 18:
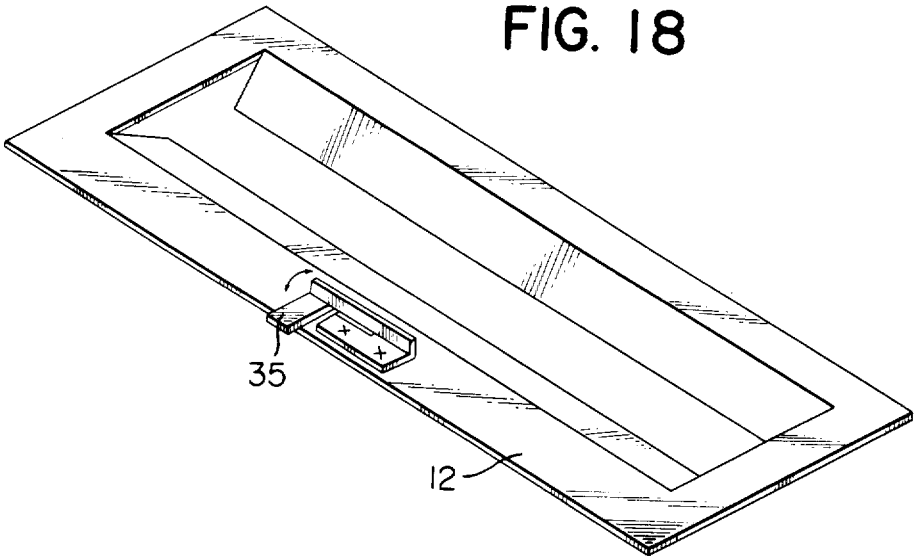
FIGS. 18 and 19 are perspective views showing a supply container for the developer in FIG. 17.
Figure 19:
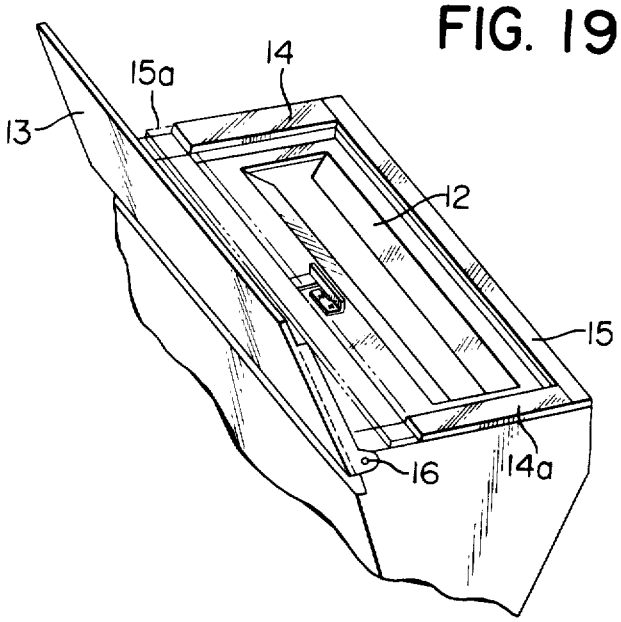

In the illustrated embodiment of this invention, the inner lid 12 is formed into a funnel-shape to facilitate the supply of the developer as shown in FIGS. 17 to 19. Thus, the flying particles of toner are prevented from leaking outside to return inwardly in the development vessel as shown by arrows S. Furthermore, the toner particles on the inner lid will be easily dumped into the development vessel due to the funnel configuration of the inner lid. For easy access to the interior of the development vessel, the inner lid 12 is normally urged toward the illustrated position by means of a stopper in the form of a leaf spring 35 as shown in FIG. 18. If desired, the inner lid 12 may be removed by disengaging the leaf spring 35 from the recess of the forward stay 6.

A manner in which the development vessel 8 is closed by the outer lid 13 will now be described with reference to FIGS. 17 and 18. When the level of toner is positioned at a location shown by a letter $1_1$ in FIG. 17, the toner particles cannot be leaked even by closing and opening the outer lid 13. When the toner is of such a level as shown by a letter $1_2$ that there is a extremely small amount of toner in the vessel, a problem results. If the outer lid 13 is abruptly closed, air is passed into the development vessel in a direction U. If sealing means is provided around the top opening of the development vessel, the passed air tends to vent through the gap between the stay 7 and the sleeve 2 since it is confined within the development vessel without any leaking path except said gap. As a result, the toner particles in the vessel leak in the direction X with the air. These leaking toner particles adhere to an optical system, charged instruments and the like, thereby causing them to break down. In the one component developing process, a gap is necessarily produced between the sleeve 2 and the stay 7 for avoiding the dispersion of toner. Therefore, the above leakage of toner is a serious problem when the outer lid is hinged on the machine. The toner particles which are flown up by some upward flow of air cannot be readily prevented from leaking since it is difficult to block completely between the outer lid 13 and the development vessel 8.

In order to overcome the above problem, the outer lid 13 of this invention includes an iron plate 13a disposed therewithin which is attracted by magnetic rubbers 14, 14*a* and 15 located on the top face of the development vessel to seal completely the vessel 8 by the outer lid 13. Even if there is any gap between the iron plate 13*a* and the magnetic rubbers 14, 14*a* and 15, the magnetic toner particles can be easily caught by these magnetic rubbers to prevent them from leaking outside. If a magnetic rubber 15*a* is located as shown by a two-dot-dash line in FIG. 19, the passed air is confined within the vessel 8 without any leaking path except the gap between the sleeve and the lower stay 7. In accordance with this invention, such a magnetic rubber 15*a* is eliminated to pass the air through the resulting gap. However, the inner lid 12 substantially prevents the flown-up toner particles from reaching the outer lid 13.

Figure 20:
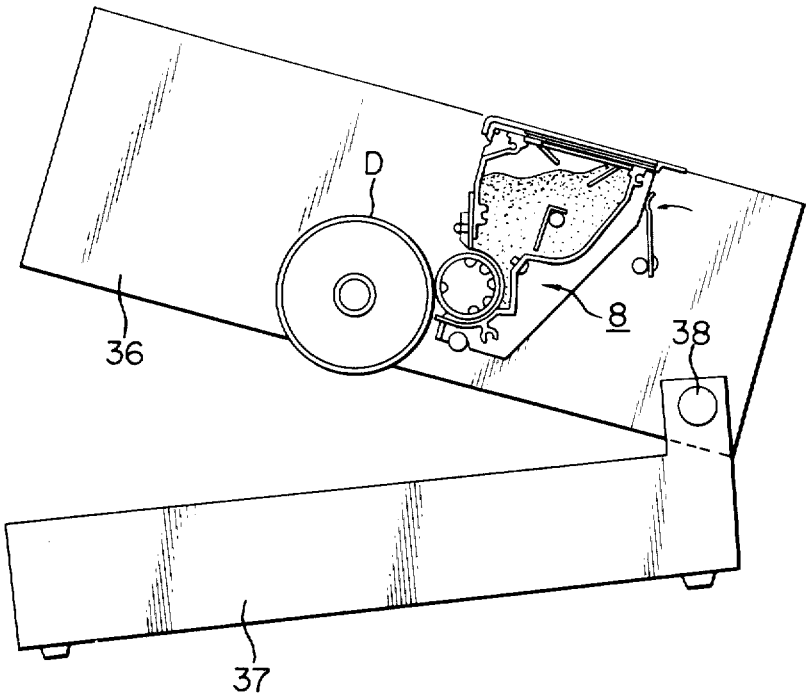
FIG. 20 is a view illustrating an image-forming machine in such a condition that it is separated into two portions, said image-forming machine including the developing apparatus of FIG. 1.

In the illustrated embodiment of this invention, the magnetic rubber 15*a* is eliminated mainly for causing the air to leak from the vessel 8. The reason why this magnetic rubber 15*a* is particularly eliminated at this place is that, when the reproduction machine is divided into two portions 36 and 37 by pivoting around a shaft 38 for removing any jammed paper as shown in FIG. 20, the one component developer T is moved toward the one side of the development vessel 8 in the inclined upper machine portion 36. It is therefore preferred that the magnetic rubber 15*a* is eliminated at the opposite side of the development vessel 8. Furthermore, the sealing felt element 21 is designed to be flush with the side plate 4 at least part of the development vessel, that is, above the gap $d_4$. If the felt element 21 is positioned inwardly from the side plate, the gap $d_4$ comes to be of 2 millimeters which is a thickness at such a position that the felt element is inserted, in an area spaced outwardly from the stay 7 for avoiding the dispersion of toner. In such an area that the side plate 4, sleeve 2 and felt element are shifted inwardly, there is formed a tunnel-shaped through which the toner particles tend to disperse outside.

While the preferred embodiments of this invention have been described with reference to the drawings, many modifications and changes may be carried out by those skilled in the art without departing the scope of the invention which will be defined by the appended claims.

What we claim is:

1. A developing apparatus for supplying developer to a latent image on a latent image bearing member to develop it, said apparatus comprising means for supplying one-component magnetic toner as said developer, a movable developer carrying member having a surface for receiving the supplied developer, a thickness limiting member of magnetic material or a magnet disposed close to the surface of said developer carrying member for limiting the layer of developer on said developer carrying member to a predetermined small thickness, fixed magnetic field producing means disposed within said developer carrying member, said magnetic field producing means having a magnetic pole positioned in facing relationship with said thickness limiting member, and means for mounting said thickness limiting member for slideable movement toward and away from the facing magnetic pole, said mounting means including locking means for maintaining a predetermined distance between said thickness limiting member and said developer carrying member, an adjusting plate mounted on said supply means, pin means cooperating with at least one opening in said thickness limiting member for positioning said adjusting plate and said thickness limiting member, and wherein said locking means includes means for connecting said adjusting plate with said thickness limiting member, and wherein said opening in said thickness limiting member has a diameter larger than that of said pin means, said pin means being offset relative to said opening, said thickness limiting member being adapted to move toward said developer carrying member under the influence of the facing magnetic pole.

2. The developing apparatus as defined in claim 1 wherein said developer carrying member is a non-magnetic sleeve, the edge of said thickness limiting member which faces said non-magnetic sleeve being movable along a straight line by which the center of said sleeve is connected with said edge of said thickness limiting member, by regulating said adjusting plate.

3. A developing device for supplying developer to a latent image on a latent image bearing member to develop it, said apparatus comprising a development assembly including means for supplying a one-component magnetic toner as said developer, a developer carrying member having a surface for receiving the supplied developer, magnetic field-producing means disposed within said developer carrying member, and a thickness limiting member disposed close to the surface of said developer carrying member for limiting the layer of developer on said developer carrying member to a predetermined small thickness, said developer carrying member including a development sleeve having, connected at both longitudinal ends, shaft means rotatably supported on said developer supply means and extending outwardly therefrom, a gap maintaining member for maintaining a gap between said latent image bearing member and said development sleeve mounted on each of said shaft means outside said developer supply means, wherein both ends of said magnetic field-producing means are journaled on said sleeve and one end thereof penetrates through one of said shaft means to the outside thereof, and wherein said magnetic field-producing means is fixed to said developer supply means by a rotation preventing member connected to said one end of said magnetic field-producing means.

4. The developing apparatus as defined in claim 3 wherein each of said shaft means has an external diameter smaller than that of said development sleeve, said gap maintaining member being rollers which are fitted over the corresponding shaft means.

5. The developing apparatus as defined in claim 3 wherein said development sleeve is rotatable in the same direction and substantially at the same speed as said latent image bearing member, at the closest position relative to said latent image bearing member, the gap between the development sleeve and the latent image bearing member being a dimension larger than the thickness of the toner layer which is formed on said development sleeve.

6. The developing apparatus as defined in claim 5 wherein the thickness of said toner layer is in the range of from $50\mu$ to $100\mu$.

7. The developing apparatus as defined in claim 5 wherein the gap between said latent image bearing member and the developer carrying member is in the range of from $100\mu$ to $330\mu$.

8. The developing apparatus as defined in claim 4 wherein the revolution of said development sleeve is substantially equal to those of said rollers which are rotated together with said latent image bearing member.

9. The developing apparatus as defined in claim 4, wherein the shaft means on the opposite ends of said development sleeve are supported rotatably by means of bearings which are located respectively on forward and rearward side plates of said supply means, said rollers being disposed outside of said side plates.

10. The developing apparatus as defined in claim 4 wherein said rollers contact the area of said latent image bearing member which is not covered with a photosensitive layer.

11. The developing apparatus as defined in claim 10 wherein said rollers contact an insulating layer on said latent image bearing member.

12. A developing apparatus for supplying developer to a latent image on a latent image bearing member to develop it, said apparatus comprising a development assembly including means for supplying one-component magnetic toner as said developer, a developer carrying member having a surface for receiving the supplied developer, magnetic field-producing means disposed within said developer carrying member, and a thickness limiting member disposed close to the surface of said developer carrying member for limiting the layer of developer on said developer carrying member to a predetermined small thickness, wherein said developer carrying member is rotated through a driving connection between a gear mounted on said developer carrying member and another gear mounted on said latent image bearing member, and further comprising a shaft as a center of rotation for supporting said development assembly, said shaft being disposed substantially on an extension of a line along which a force is transmitted from the gear of said latent image bearing member to the gear of said developer carrying member, said development assembly being adapted to pivot around said shaft.

13. The developing apparatus as defined in claim 12, further comprising means for forcing said developer carrying member into engagement with said latent image bearing member and gap maintaining means for maintaining the gap between said developer carrying member and said latent image bearing member constant against the influence of said forcing means.

14. A developing apparatus for supplying developer to a latent image on a latent image bearing member to develop it, said apparatus comprising means for supplying one-component magnetic toner as said developer, a developer carrying member having a surface for receiving the supplied developer, magnetic field-producing means disposed within said developer carrying member, and a thickness limiting member disposed close to the surface of said developer carrying member for limiting the layer of developer on said developer carrying member to a predetermined small thickness, wherein said developer supplying means is a developer vessel which includes an outer lid disposed adjacent to the top thereof and an inner lid of funnel shape which is located directly below said outer lid, said inner lid having edges which define an aperture and block reverse toner flow.

15. The developing apparatus as defined in claim 14 wherein said inner lid is detachably mounted on said developer vessel.

16. The developing apparatus as defined in claim 14, further comprising magnet means for holding said outer lid sealingly on said developer vessel.

17. The developing apparatus as defined in claim 14 wherein said developer apparatus is located within a machine frame, said machine frame being divisible into two parts when said developing apparatus is not in operation and when so divided, said developing apparatus being inclined, said developer vessel being formed with a gap for venting between said outer lid and said vessel at an area of said vessel or machine frame which is positioned at the highest level in said inclined position.

18. A developing apparatus for supplying developer to a latent image on a latent image bearing member to develop it, said apparatus comprising means for supplying one-component magnetic toner as said developer, a developer carrying member having a surface for receiving the supplied developer, magnetic field-producing means disposed within said developer carrying member, and a thickness limiting member for limiting the layer of developer on said developer carrying member to a predetermined small thickness, wherein said developer carrying member is a rotatable development sleeve, and further comprising felt elements which are located adjacent to the opposite ends of said sleeve contacting partly with the outer periphery of said sleeve adjacent to the opposite ends thereof and outside the developing region, said felt elements having end portions facing each other for preventing the toner applied to said sleeve from said supplying means from moving to the ends of said sleeve, each of said facing end portions having a slanted surface portion which extends inwardly, in the rotation direction of said sleeve, toward the other slanted portion to direct toner inwardly along said sleeve and away from the end portions thereof.

19. The developing apparatus as defined in claim 18 wherein said developer supplying means is a developer vessel which, at its lower portion, forms a narrow gap ($d_4$) together with said sleeve, said facing end portions of said felt elements being flush with the respective side plates of said developer vessel at a position spaced upwardly from at least said lower portion of said developer vessel.

20. The developing apparatus as defined in claim 18 wherein said felt elements are overlapped with the magnetic field-producing means in said sleeve.

21. The developing apparatus as defined in claim 19 wherein said gap ($d_4$) is in the range of from 0.7 millimeter to 1.3 millimeter.

22. The developing apparatus as defined in claim 19 wherein said magnetic field producing means is fixed and said narrow gap ($d_4$) is formed at a position in which a magnetic pole of said magnetic field-producing means is located.

23. A developing apparatus for supplying developer to a latent image on a latent image bearing member to develop it, said apparatus comprising means for supplying one-component magnetic toner as said developer, a developer carrying member having a surface for receiving the supplied developer, fixed magnetic field-producing means disposed within said developer carrying member, and a thickness limiting member disposed close to the surface of said developer carrying member for limiting the layer of developer on said developer carrying member to a predetermined small thickness, wherein said developer carrying member is a rotatable development sleeve, further comprising a member for preventing the fall of developer which is disposed substantially directly below said sleeve, said preventing member defining a gap together with said sleeve which gap is converged in the direction of rotation of said sleeve to form a narrowest gap, a magnetic pole ($N_2$) of said magnetic field-producing means being located within said sleeve adjacent to said narrowest gap in the direction of rotation of said sleeve.

24. The developing apparatus as defined in claim 23 wherein said magnetic pole ($N_2$) has a polarity opposite from that of a development pole ($S_1$), said poles being angularly spaced away from each other with an angle of 70 degrees or more.

* * * * *